US009694219B2

(12) United States Patent
Hallmark

(10) Patent No.: US 9,694,219 B2
(45) Date of Patent: Jul. 4, 2017

(54) SAFETY HARNESS FOR CLIMBING TREE STAND

(71) Applicant: Jason P Hallmark, Tarrant City, AL (US)

(72) Inventor: Jason P Hallmark, Tarrant City, AL (US)

( * ) Notice: Subject to any disclaimer, the term of this patent is extended or adjusted under 35 U.S.C. 154(b) by 0 days.

(21) Appl. No.: 14/866,879

(22) Filed: Sep. 26, 2015

(65) Prior Publication Data

US 2016/0074684 A1 Mar. 17, 2016

Related U.S. Application Data

(63) Continuation-in-part of application No. 14/484,913, filed on Sep. 12, 2014, now abandoned.

(51) Int. Cl.
*A63B 27/00* (2006.01)
*A62B 35/00* (2006.01)

(52) U.S. Cl.
CPC ..... *A62B 35/0025* (2013.01); *A63B 27/00* (2013.01)

(58) Field of Classification Search
CPC . A62B 35/00; A62B 35/0006; A62B 35/0012; A62B 35/0018; A62B 35/0025; A62B 35/0031; A62B 35/0037
USPC ..... 182/3, 136
See application file for complete search history.

(56) References Cited

U.S. PATENT DOCUMENTS 4,524,792 A * 6/1985 Tzabanakis ..... E04H 15/00 135/148
4,552,246 A * 11/1985 Thomas ..... A01M 31/02 182/116
5,279,390 A * 1/1994 Phillips ..... E06C 1/381 182/116
5,595,333 A * 1/1997 Boston ..... B60R 7/14 211/60.1
5,664,643 A * 9/1997 Taylor, Jr. ..... E06C 7/482 182/107
5,954,158 A * 9/1999 Concepcion ..... A01M 31/02 182/136
6,206,138 B1 3/2001 Yerger
6,243,979 B1 * 6/2001 Seats ..... A01M 31/025 182/135
6,308,801 B1 * 10/2001 Futch ..... A01M 31/02 182/136
8,240,432 B2 * 8/2012 Call ..... A01M 31/02 182/133

(Continued)

*Primary Examiner* — Jerry Redman
(74) *Attorney, Agent, or Firm* — J.T. Hollin, Attorney at Law, P.C.

(57) ABSTRACT

The inventive concept is a safety device, which is an emergency safety system constructed so as to be clamped to a climbing tree stand typically used by an outdoorsman, particularly a hunter. The objective of the device is to safely expedite the vertical positioning of a tree mounting strap during ascent and/or descent of a tree. This is accomplished by means of symmetrical left and right assemblages of rigid mounting arms, brackets, and retention clasps which, when combined, hold a the tree mounting strap loosely around the circumference of a tree trunk. Should the climber experience an imminent fall from the tree, the arms of the safety device will cause the un-tensioned tree mounting strap (to which the hunter's body safety harness is attached) to collapse against the tree trunk. This tightening action will arrest the fall immediately and prevent serious injury.

1 Claim, 6 Drawing Sheets

(56) References Cited

U.S. PATENT DOCUMENTS

| | | | | |
|---|---|---|---|---|
| 2003/0029675 | A1* | 2/2003 | Prejean | A01M 31/02 182/136 |
| 2004/0098921 | A1* | 5/2004 | Ward | B60J 5/0402 49/502 |
| 2007/0175702 | A1* | 8/2007 | Simone | A01M 31/02 182/187 |
| 2007/0227818 | A1* | 10/2007 | Bedell | A01M 31/02 182/136 |
| 2009/0236178 | A1 | 9/2009 | Wood | |
| 2011/0127110 | A1* | 6/2011 | Trang | E06C 7/44 182/111 |
| 2012/0018250 | A1 | 1/2012 | Smith | |
| 2013/0025969 | A1* | 1/2013 | Horn | E06C 7/18 182/8 |
| 2013/0025970 | A1 | 1/2013 | Plouffe | |

* cited by examiner

SAFETY HARNESS FOR CLIMBING TREE STAND

CROSS-REFERENCES TO RELATED APPLICATIONS

This application is a Continuation-in-Part of U.S. Published patent application Ser. No. 14/484,913 filed on Sep. 12, 2014, which has been abandoned. Thus, this Continuation-in-Part application claims the benefit and the content of the previous application Ser. No. 14/484,913 by specific reference thereto as if fully appearing in the current application.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concept is involved with the use of climbing tree stands for ascending and descending from trees. Most climbing tree stands are comprised of a seat portion and a footstep for placement of the climber's feet. Climbers typically use a body harness, which includes an adjustable strap for wrapping around the trunk of the tree during ascent or descent. The adjustable strap will be referred to as a tree mounting strap for the purposes of this disclosure. The tree mounting strap may be fastened to the climbing tree stand with a bolt, pin, or tensioned buckle for easy adjustment for different tree sizes. The tree mounting strap may also be fastened to an overall body harness worn by the tree climber.

(2) Description of the Related Art, Including Information Disclosed Under 37 CFR 1.97 and 1.98

US # 2012/0018250 A1 (Jan. 26, 2012 discloses a safety strap assembly which is used by a climber for ascending, remaining secured at height and descending from a tree or pole. The safety strap assembly includes a tubular strap; an elastic strap; a stiffening member; a string; a coupling; and a finger-pull. Optionally, an oval chain-link is included. The tubular strap fits around a tree. One end of the tubular strap is connected to an elastic strap. The other end is attachable to the climber. The stiffening member fits within the tubular member. A string extending from two holes in the tubular strap permit the stiffening member to be shifted. The coupling at the free end of the elastic strap connects to the tubular strap in a removable slidable engagement. The finger-pull at that connection breaks away if the climber falls enabling the tubular strap to engage the tree and prevent a fall to the ground.

US # 2009/0236178 A1 (Sep. 24, 2009 is an inventive device featuring a Tree Stand Safety Belt to prevent a wearer/user from falling out of a tree stand used for viewing or hunting wildlife. When properly positioned and securely attached, the device of this invention maintains substantially continuous contact of the wearer's back to a tree trunk. This contact not only provides a physical barrier to moving; that sense of contact also protects its wearer/user from experiencing height disorientation and possibly losing their balance. The device is designed for its wearer to use in either a sitting or standing position.

U.S. Pat. No. 6,206,138 B1 (Mar. 27, 2001 discloses a tree stand safety belt to facilitate climbing of a tree with a climbing tree stand without interfering with climbing movement of the tree stand, and while allowing the belt to be curled up when not in use. The belt body is made of a flexible web of cloth-like material, such as polyester or nylon webbing, and has first and second ends. An attachment device, such as a clip, is provided at the second end, and a loop is typically formed at the first end that allows the second end to pass through it. A stiffening element, such as a chain, is provided at a central portion of the belt between the first and second ends, for example sandwiched between a strip of webbing stitched to the belt body and the belt body itself. During use the belt is connected by a releasable attachment device (such as a spring clamp) to a side support or tree engaging element of the upper frame of a tree stand.

BRIEF SUMMARY OF THE INVENTION

The subject safety device, having a marketing name, "Possum Tail Tree Stand," is an emergency safety system designed to simplify the task of continually adjusting a tree mounting strap while ascending or descending a tree on a climbing tree stand. The tree mounting strap is a component which is either fastened to the climbing tree stand or to a body harness typically used by a tree climber. The inventive concept is designed to be affixed to a climbing tree stand typically used by an outdoorsman, particularly a hunter. The objective of the device is to facilitate quick use of the tree mounting strap when repositioning the tree mounting strap at different vertical increments on the tree, whether ascending or descending utilizing a climbing tree stand.

The device enables the hunter to remain in his standard tree climbing safety harness from beginning ascent using a climbing tree stand, maintaining a selected tree position, and descending from the tree. The device eliminates the need for the climber to continuously cinch and un-cinch the tree mounting strap while ascending or descending. This is accomplished by means of an adjustable assemblage of metal (or plastic) mounting arms and brackets which, when combined, hold the tree mounting strap within a plurality of retention clasps. Should the hunter begin to fall from the tree through either hunter carelessness or a malfunctioning tree stand, the retention clasps will immediately release, causing the tree mounting strap (to which the hunter's body safety harness is connected) to tighten against the tree trunk. This tightening action will arrest the hunter's fall immediately and prevent serious injury.

DETAILED DESCRIPTION OF THE INVENTION

The objects, features, and advantages of the concept presented in this application are more readily understood when referring to the accompanying drawings. The drawings, totaling fifteen figures, show the basic components and functions of embodiments and/or methods of use. In the several figures, like reference numbers are used in each figure to correspond to the same component as may be depicted in other figures.

Figure 1:
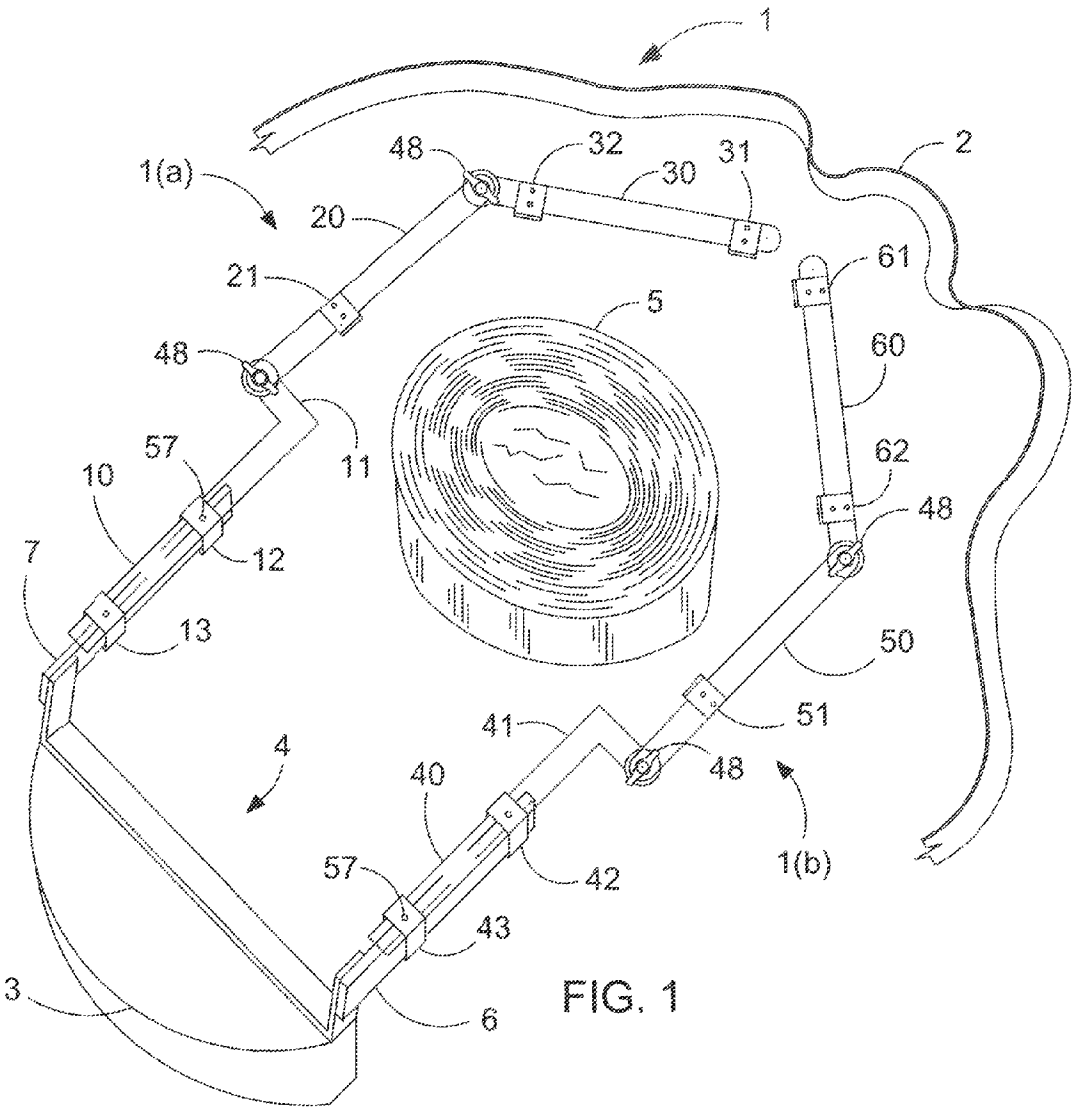
FIG. 1 depicts a general view of the emergency safety system, 1, and stylized portrayals of a climbing tree stand 3 and the outline of a tree trunk 5.

The discussion of the present inventive concept will be initiated with FIG. 1, which shows that the safety system 1 comprises symmetrical left and right sides. The left side safety harness 1(*a*) consists of three sequentially-connected, rigid arms, being a left attachment arm 10, a mid-left offset arm 20, and an outer left offset arm 30. Similarly, the right side safety harness 1(*b*) comprises, in sequence, a right attachment arm 40, a mid-right offset arm 50, and an outer right offset arm 60.

In FIG. 1, the left side safety harness 1(*a*) and the right side safety harness 1(*b*) of the safety system 1 are shown positioned just prior to the preliminary stage of encirclement of a tree trunk 5. Shown is a portion of a tree mounting strap 2 which may be a component of the typical full body harness worn by tree climbers. A full body harness also typically includes two leg harnesses and a chest harness. The chest harness contains connections for adjusting and locking the tree mounting strap 2, which strap 2 is then looped around the circumference of a tree trunk. The tree mounting strap 2 is incrementally un-cinched (or unlocked) and re-cinched as the climber ascends a tree. The tree mounting strap 2 may also be a flexible, strengthened material comprising a body harness which is also functional with the safety system 1.

By way of contrast, as shown in FIG. 1, when a climber initiates use of the disclosed inventive concept, the tree mounting strap 2 will be inserted in the emergency safety system 1 within special elastomeric retention clasps 21, 32, 31 on the mid-left offset arm 20 and outer left offset arm 30, respectively. The tree mounting strap 2 is further inserted through elastomeric retention clasps 61, 62, and 51 on the outer-right offset arm 60 and the mid-right offset arm 50, respectively.

FIG. 1 illustrates a comprehensive view of the emergency safety system 1 in the configuration of attachment to a stylized climbing tree stand 3 and tree stand seat 4. A left side brace 7 (or armrest) and a right side brace 6 (or armrest) of the climbing tree stand 3 provide the attachment points for the emergency safety harness 1(*a*), 1(*b*). The left attachment arm 10 of the safety system 1 is clamped to the left side brace 6 of the tree stand seat 4, while the right attachment arm 40 is clamped to the right side brace 7 of the tree stand seat 4. A left front attachment bracket 12, a left rear attachment bracket 13, a right front attachment bracket 42, and a right rear attachment bracket 43 are used to attach both sides of the emergency safety harness 1(*a*), 1(*b*) to the right side brace 6 and the left side brace 7 of the climbing tree stand seat 4.

Figure 2:
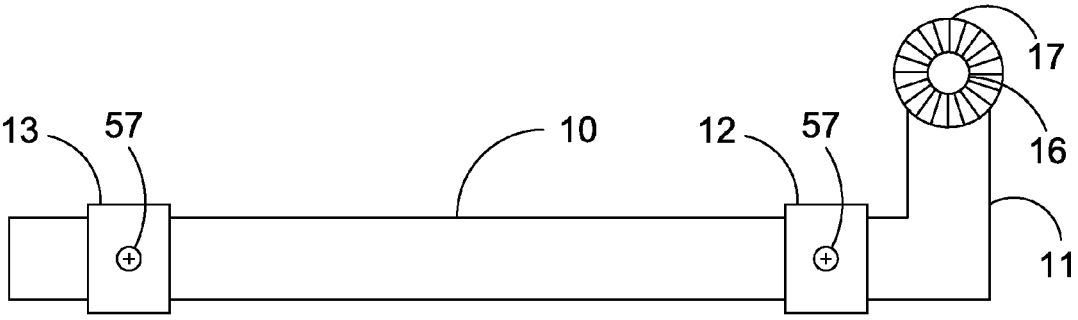
FIG. 2 illustrates a view of the upper surface of the left attachment arm 10.
Figure 3:
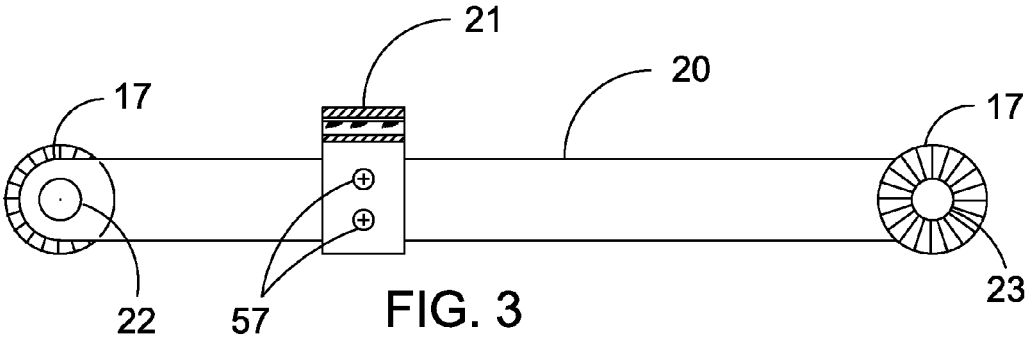
FIG. 3 is a top view of the mid-left offset arm 20, along with the left strap retention clasp 21.
Figure 4:
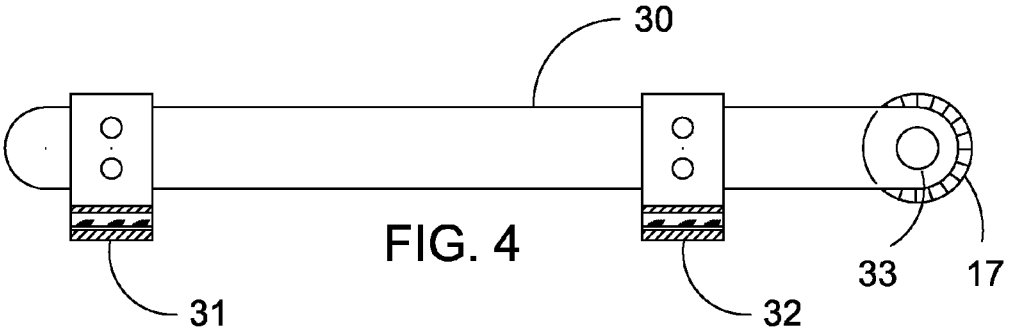
FIG. 4 presents a view of the upper surface of the outer left offset arm 30.

FIG. 2, FIG. 3, and FIG. 4 display disconnected views of the top surfaces of the three components of the left side safety harness 1(*a*). The topmost component shown in FIG. 2 is the upper surface of the left attachment arm 10. A left rear attachment bracket 13 and a left front attachment bracket 12 are affixed to the left attachment arm 10 by means of two machine screws 57. These two attachment brackets 12, 13 are designed to clamp the left side harness 1(*a*) to the left side brace 7 (or arm) of the tree stand seat 4.

The rightmost end of the left attachment arm 10 comprises an elbow 11, which protrudes orthogonally outwardly from alignment with the left attachment arm 10. This protrusion provides for an offset connection of the left attachment arm 10 to the mid-left offset arm 20 (shown in FIG. 3). The mid-left offset arm 20 is the center component of the left side safety harness 1(*a*).

Reviewing more of the details in FIG. 2, the upper surface of the left attachment arm 10 further includes an aperture 16, a tensioned safety washer 17, and the orthogonal elbow 11. The left front bracket 12 and the left rear bracket 13 are affixed to the left attachment arm 10 by means of a machine screw 57 passing through threads in each bracket 12, 13 and corresponding threads in the left attachment arm 10.

Figure 2A:
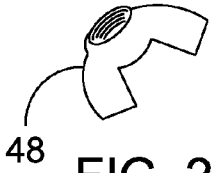
FIG. 2A depicts a typical wing nut 48 used in various places in the inventive concept.
Figure 2B:
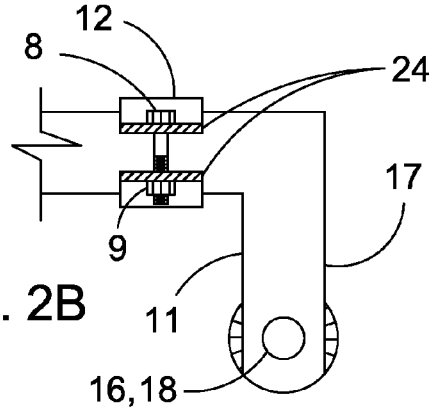
FIG. 2B is a view of the underside of the elbow 11 of the left attachment arm 10, further showing the underside of the left front bracket 12.

FIG. 2B depicts the underside of the elbow 11 and the underside of the left front bracket 12, which terminates in two flanges 24. The relative orientation of the two flanges 24 are illustrated more clearly in FIG. 10 and FIG. 11, which is a view of the left front bracket 12 as seen from the perspective of section line 11-11. A hexagonal head bolt 8 and corresponding nut 9 fasten the two flanges 24 together to securely encompass the left side brace 7 of a typical climbing tree stand seat 3, as previously shown in FIG. 1. Similarly, the left rear bracket 13 utilizes the same arrangement of clamping components, being a hexagonal head bolt 8, nut 9, and two flanges 24.

Figure 13:
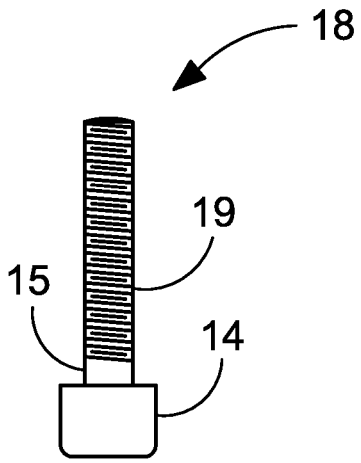
FIG. 13 illustrates the pivot arm bolt 18 used in conjunction with a wing nut 48.

In the arrangement of the left side harness 1(*a*), the left attachment arm 10 must be attached, at its elbow 11, to the mid-left offset arm 20. In referring to FIG. 2B, the manner of fastening the left attachment arm 10 and the mid-left offset arm 20 is shown. Prior to attachment of the left elbow 11 to the mid-left offset arm 20, a tensioned safety washer 17 is placed in axial alignment with the aperture 16 atop the left attachment arm 10. An elastomeric bolt 18 (fully shown in FIG. 13) is inserted through the undersurface of the elbow 11. The mid-left offset arm 20 contains a rear aperture 22 corresponding to the aperture 16 of the left attachment arm 10. Both apertures 16, 22, are placed coaxially to allow insertion of the pivot arm elastomeric bolt 18 through the tensioned safety washer 17 and both apertures 16, 22. A wing nut 48 is then used to securely tighten the connection of the left elbow 11 to the mid-left offset arm 20.

Figure 8:
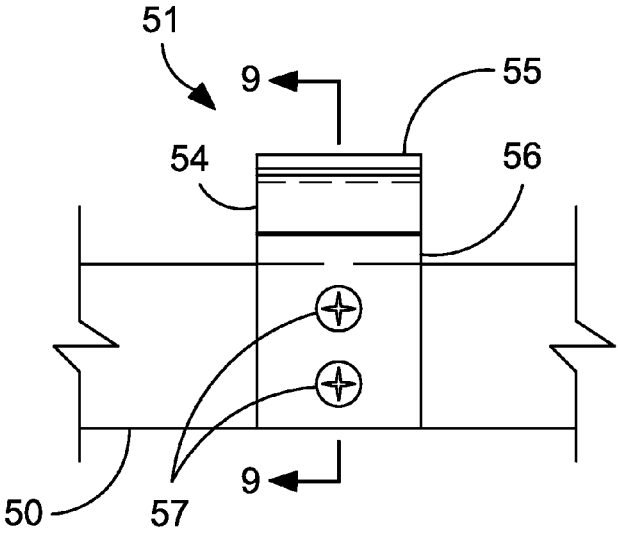
FIG. 8 illustrates a view of a strap retention clasp 51, looking inward toward the machine screws 57 which secure the clasp.
Figure 9:
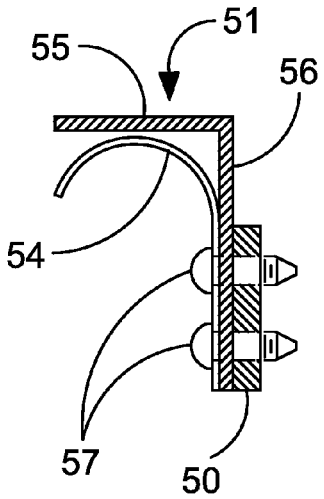
FIG. 9 is a side view of the strap retention clasp 51 shown in FIG. 8.

An elastomeric left strap retention clasp 21 is shown affixed to the upper surface of the mid-left offset arm 20. The left strap retention clasp 21 provides a grasp-like conduit through which the tree mounting strap 2 is inserted. The means by which the left strap retention clasp 21 retains the tree mounting strap 2 is illustrated in FIG. 8 and FIG. 9. FIG. 8 presents a downward-looking view of the right strap retention clasp, while FIG. 9 presents a side view of the right strap retention clasp 51, as seen from the perspective of section line 9-9. The left strap retention clasp 21 is identical to the elastomeric right strap retention clasp 51, and the left strap retention clasp 21 operates with the exact same components and in the same manner as the right strap retention clasp 51.

The third component of the left side safety harness 1(*a*), is an outer-left offset arm 30, is shown in FIG. 4. The outer-left offset arm 30 is connected, via its aperture 33, in sequence with the forward aperture 23 of the mid-left offset arm 20 by means of a tensioned safety washer 17, a pivot arm elastomeric bolt 18, and a wing nut 48. An left front retention clasp 31 and an elastomeric left rear retention clasp, 32 are affixed to the upper surface of the outer left offset arm 30 to provide a grasp-like conduit for control and positioning, and retention of the tree mounting strap 2. As discussed before, the means of positioning and grasping of the tree mounting strap 2 is illustrated in both FIG. 8 and FIG. 9, by virtue of the identical configuration and components of the right strap retention clasp 51.

The left attachment arm 10, mid-left attachment arm 20, and the outer left offset arm 30 are sequentially attached to each other to form the left side harness 1(*a*).

Figure 5:
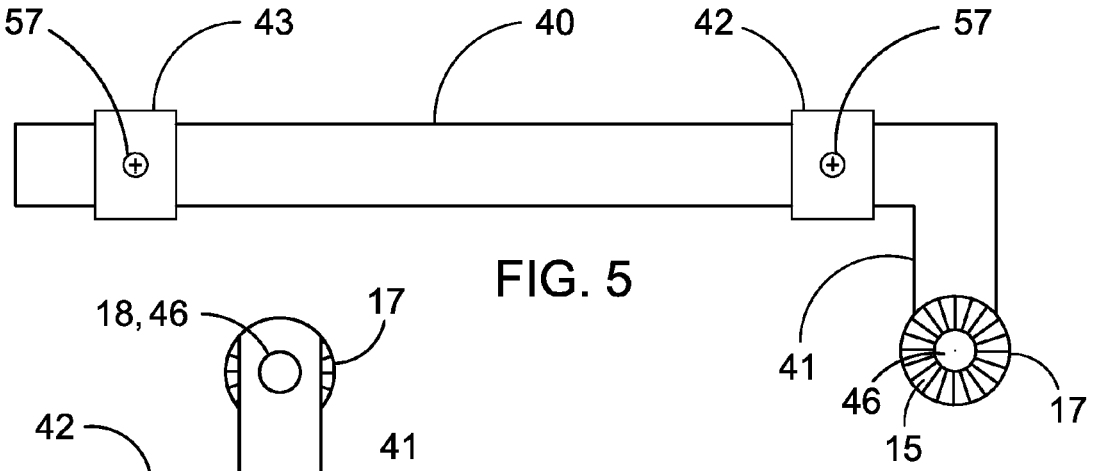
FIG. 5 shows a view of the upper surface of the right attachment arm 40.
Figure 6:
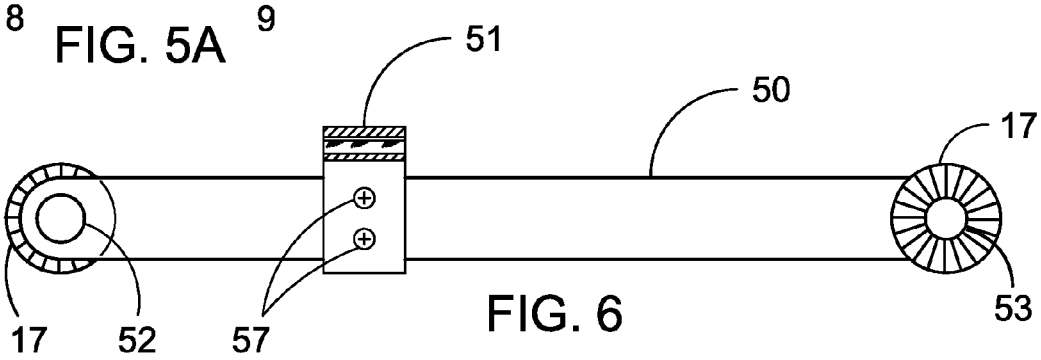
FIG. 6 is a view of the upper surface of the mid-right offset arm 50.
Figure 7:
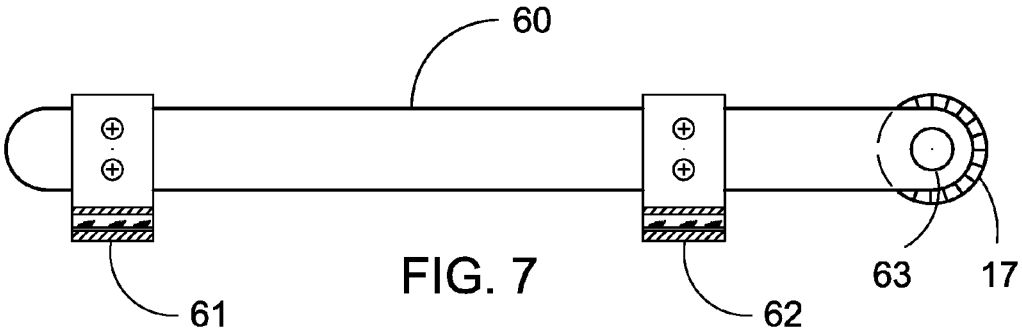
FIG. 7 presents a view of the upper surface of the outer-right offset arm 60.

FIG. 5, FIG. 6, and FIG. 7 present views of the top surfaces of the components of the right side harness 1(*b*). The topmost component shown is the upper surface of the right attachment arm 40. A rear attachment bracket 43 and a from attachment bracket 42 are affixed to the right attachment arm 40 and are designed to be coupled to the right side brace 7 of the tree stand seat 4. The leftmost end of the right attachment arm 40 comprises an elbow 41, which protrudes outwardly from alignment with the side brace 7 of the tree stand seat 4. This protrusion enables connection of the right attachment arm 40 to the mid-right offset arm 50, which is the center component shown in FIG. 6.

Figure 5A:
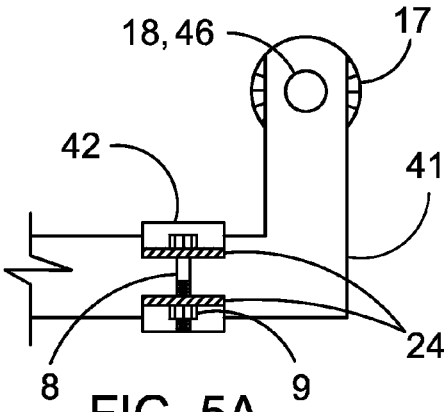
FIG 5A illustrates a view of the underside of the elbow 41 of the right attachment arm 40.

Reviewing more of the details shown in FIG. 5, there is shown a view of the upper surface of the right attachment arm 40, including a right front bracket 42, a right rear bracket 43, an aperture 46, a tensioned safety washer 17, and the orthogonal elbow 41. The right front bracket 42, and the right rear bracket 43 are permanently affixed to the right attachment arm 40 by means of a machine screw 57 passing through threads in each bracket 42, 43. FIG. 5A depicts the underside of the elbow 41 and the underside of the right front bracket 42, which terminates in two flanges 19. A hexagonal head bolt 8 and nut 9 fasten the two flanges 24 together to encompass the right side brace 6 of a typical tree stand 3, as shown in FIG. 1.

In the arrangement of the right side harness 1(*b*), the right attachment arm 40 must be attached, at its elbow 41, to the mid-right offset arm 50, shown in FIG. 6. Prior to attachment of the right elbow 41 to the mid-right offset arm 50, a tensioned safety washer 17 is placed in axial alignment with the aperture 46 atop the right attachment arm. An elastomeric bolt 18 (shown in FIG. 13) is then inserted through the undersurface of the elbow 41. The mid-right offset arm 50 has a rear aperture 52 corresponding to the aperture 46 of the right attachment arm 40. Both apertures 46, 52, are placed coaxially to allow insertion of the pivot arm elastomeric bolt 18 through the tensioned safety washer 17 and both apertures 46, 52. A wing nut 48 (shown in FIG. 2A) is then used to securely tighten the connection of the right elbow 41 to the mid-right offset arm 50. An elastomeric right strap retention clasp 51 is affixed to the upper surface of the mid-right offset arm 50, which allows a grasp-like conduit for positioning, and securing the tree mounting strap 2 (illustrated in FIG. 14).

The third component of the right side harness 1(*b*), an outer-right offset arm 60, is shown in FIG. 7. The outer-right offset arm 60 is connected, by means of an aperture 63, in sequence with the forward aperture 53 of the mid-right offset arm 50 by means of a tensioned safety washer 17, a pivot arm elastomeric bolt 18, and a wing nut 48. An elastomeric right front retention clasp 61 and an elastomeric right rear retention clasp, 62 are affixed to the upper surface of the outer right offset arm 60 to allow positioning and retention of the tree mounting strap 2 (not shown).

The right attachment arm 40, mid-right attachment arm 50, and the outer left offset arm 60 are sequentially attached to each other to form the right side harness 1(*b*).

FIG. 8 and FIG. 9 illustrate the right strap retention clasp 51, with FIG. 9 presenting a cross-sectional view as seen through cutaway line 9-9. The views shown in FIG. 8 and FIG. 9 of the right strap retention clasp 51 also represent the exact structure of the right front retention clasp 61, and the right rear retention clasp 62, as well as the three retention clasps, 21, 31, and 32, depicted in FIG. 1. The details common to all the retention clasps are shown in FIG. 8, using the right strap retention clasp 51 as a model. The right strap retention clasp 51 comprises a vertical plate 55 forming an integral perpendicular angle to a horizontal plate 56.

FIG. 9 presents a cross-sectional view of the retention clasp 51 as seen from section line 9-9. An arcuate, tensioned locking plate 54 is fastened to the horizontal plate 56 by means of two machine screws 57. The two machine screws 57 further continue into the mid-right offset arm 50 and thereby enable the right strap retention clasp 51 to engage and retain the body safety strap 2.

Figure 10:
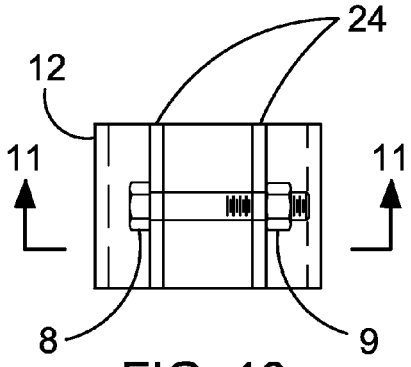
FIG. 10 illustrates the front attachment bracket 12 utilized on the left attachment arm.
Figure 11:
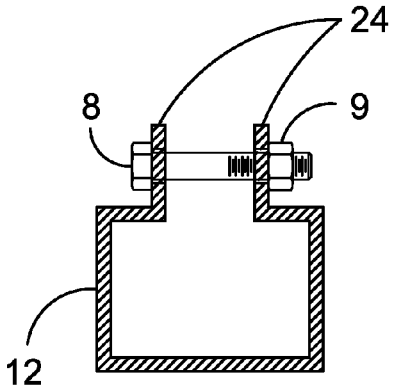
FIG. 11 displays a side view of the front attachment bracket 12 of FIG. 10.
Figure 12:
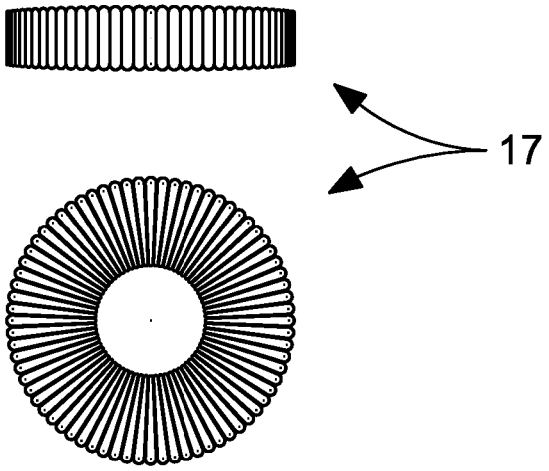
FIG. 12 is a rendering of the tensioned safety washer 17 utilized in fastening the attachment arms to the respective mid-offset arms.

As described earlier, FIG. 10 and FIG. 11 illustrate contrasting views of the left front bracket 12. The left front bracket 12 has the same construction and function as the left rear bracket 13, as well as the right front bracket 42 and the right rear bracket 43. FIG. 10 depicts an inward looking view of the right front bracket 42 showing a pair of parallel flanges 24 which have axially aligned holes permitting the insertion of a hexagonal head bolt 8 through both flanges 24 and ultimately secured by a nut 9. FIG. 11 presents a cross-sectional view, of the left front bracket 12, as seen from section line 11-11. The left front bracket 12 and the left rear bracket 13 serve to clamp the left attachment arm 10 of the safety harness 1 to the left side brace 7 of the stylized tree stand seat 4 shown in FIG. 1. The same clamping function is accomplished by the right front and rear brackets 42, 43.

Figure 14:
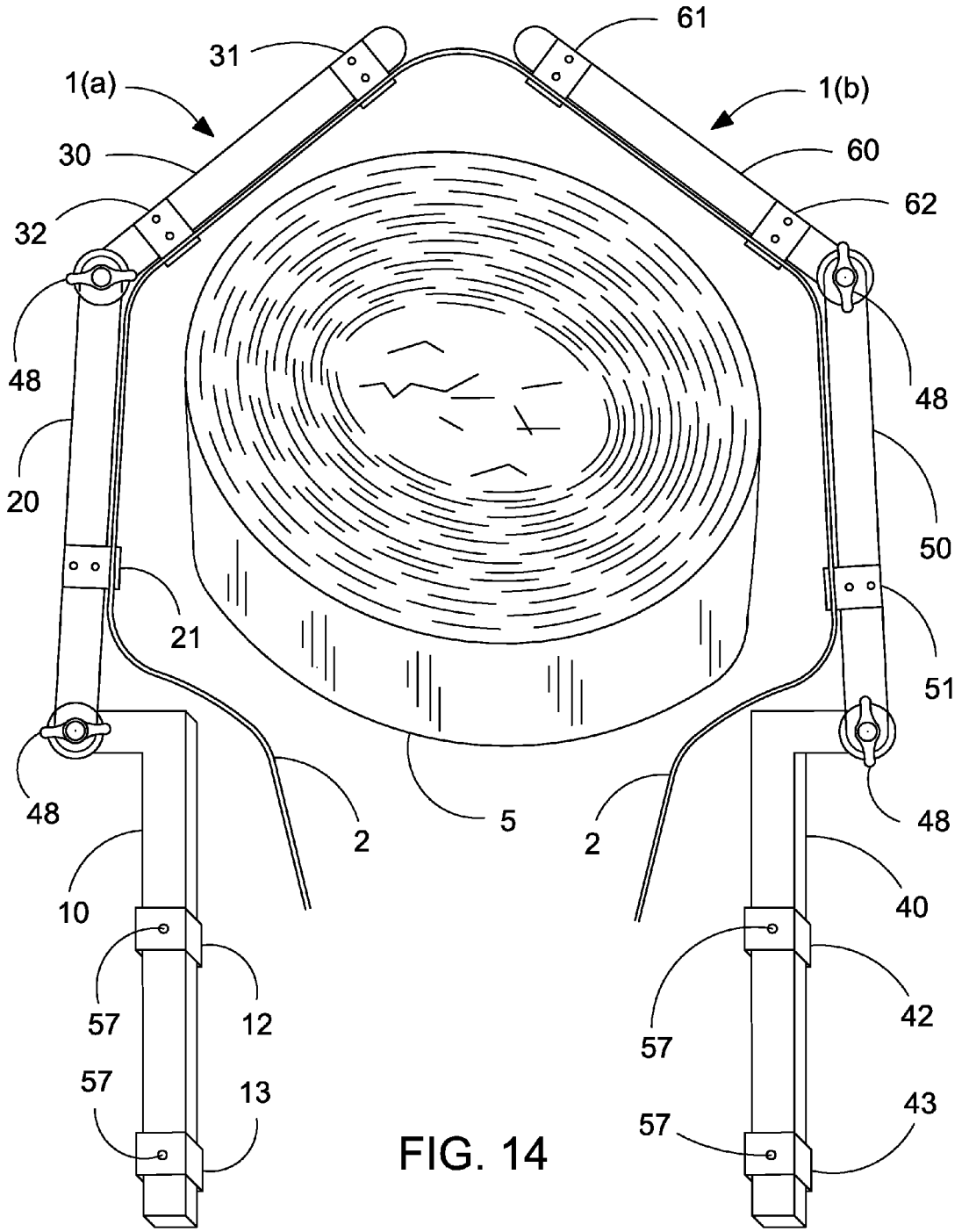
FIG. 14 shows the manner in which the tree mounting strap 2 fits into the left side and right side retention clasps of the emergency safety system 1, 1(*a*), 1(*b*).

FIG. 14 shows the manner in which the tree mounting strap 2 fits into the left side retention clasps 21, 31, 32 and right side retention clasps 51, 61, 62 of the safety harness 1, 1(*a*), 1(*b*). The device eliminates the need for the climber to continuously cinch and un-cinch the tree mounting strap 2 while ascending or descending. This is accomplished by means of the arrangement of retention clasps 21, 31, 32 51, 61, 62 in a generally circular surrounding of the trunk of the tree 5. The retention clasps 21, 31, 32, 51, 61, 62 are constructed of an elastomeric material, thus should the climber begin to fall from the tree through either accidentally or a malfunctioning climbing tree stand, the retention clasps will immediately bend and release their clasp on the tree mounting strap 2. This causes the tree mounting strap 2 (to which the hunter's body safety harness is connected) to collapse against the tree trunk 5. The collapse and tightening action of the tree mounting strap 2 will arrest the hunter's fall immediately and prevent serious injury.

While preferred embodiments of the present inventive concept have been shown and disclosed herein, it is noted that such embodiments are presented by way of example only, and not as a limitation to the scope of the inventive concept. Numerous variations, changes, and substitutions may occur or be suggested to those skilled in the art without departing from the intent and scope of this inventive concept. Such variations, changes, and substitutions may involve other features which are already known per se and which may be used instead of, in combination with, or in addition to features already disclosed herein. This inventive concept is inclusive of such variations, changes, and substitutions, and by no means limited by the wording of the claims presented herein.

What is claimed is:

1. An emergency safety system for use by a person ascending, remaining stationary at a height typically upon a tree, or descending therefrom, by use of a climbing tree stand in conjunction with a tree mounting strap, said emergency safety system comprising:

a left-side harness comprising (a) a left attachment arm having a rear attachment bracket and a front attachment bracket, said brackets of internal dimensions suitable for clamping to the left brace or armrest of a climbing tree stand, and an orthogonally-protruding elbow having an aperture; (b) a mid-left offset arm having an elastomeric strap retention clasp and an aperture at both ends; and (c) an outer-left offset arm having two elastomeric strap retention clasps and an aperture in a first end of the outer-left offset arm, wherein all said strap retention clasps are of a size to accommodate insertion of a segment of the tree mounting strap; wherein said left attachment arm, mid-left offset arm, and outer-left offset arm are sequentially attached to each other, through apertures in each arm, by means of a plurality of tensioned safety washers, pivot arm elastomeric bolts and corresponding nuts, a right-side harness comprising (d) a right attachment arm having a rear attachment bracket and a front attachment bracket, said brackets of internal dimensions suitable for clamping to the right brace or armrest of a climbing tree stand, and an orthogonally-protruding elbow having an aperture; (e) a mid-right offset arm having an elastomeric strap retention clasp and an aperture at both ends; and (f) an outer-right offset arm having two elastomeric strap retention clasps and an aperture in a first end of said outer-right offset arm; wherein all said strap retention clasps are of a size to accommodate insertion of a segment of a tree mounting strap; wherein said right attachment arm, mid-right offset arm, and outer-right offset arm are sequentially attached to each other, through apertures in each arm, by means of a plurality of tensioned safety washers, pivot arm elastomeric bolts and corresponding nuts;

both the left-side harness and the right-side harness are coupled to said climbing tree stand by means of said respective rear and front attachment brackets, whereupon said tree mounting strap is simultaneously placed around the perimeter of a tree, said tree mounting strap further being positioned and retained within said left and right strap retention clasps.

* * * * *